US006061076A

United States Patent [19]

Ishii et al.

[11] Patent Number: 6,061,076

[45] Date of Patent: May 9, 2000

[54] THERMAL RECORDER WITH MEANS FOR IMPROVED ALIGNMENT OF THERMAL HEAD BAR AND PLATEN ROLLER

[75] Inventors: Shigenori Ishii; Katsuro Motoe, both of Inashiki-gun, Japan

[73] Assignee: Riso Kagaku Corporation, Tokyo, Japan

[21] Appl. No.: 09/055,362

[22] Filed: Apr. 6, 1998

[30] Foreign Application Priority Data

Apr. 9, 1997 [JP] Japan ..... 9-106778

[51] Int. Cl.[7] ..... B41J 25/304; B41J 25/316

[52] U.S. Cl. ..... 347/197

[58] Field of Search ..... 347/197; 400/120.16

[56] References Cited

U.S. PATENT DOCUMENTS

| | | | |
|---|---|---|---|
| 4,830,523 | 5/1989 | Sparer et al. | 347/197 |
| 4,855,755 | 8/1989 | Aizawa | 347/197 |
| 4,912,483 | 3/1990 | Aizawa | 347/197 |
| 4,938,616 | 7/1990 | Shiozaki et al. | 347/197 |
| 5,114,251 | 5/1992 | Mahoney | 347/197 |
| 5,304,007 | 4/1994 | Flanagan | 347/197 |
| 5,366,302 | 11/1994 | Masumura et al. | 347/197 |

FOREIGN PATENT DOCUMENTS

| | | |
|---|---|---|
| 0 311 982 A2 | 4/1989 | European Pat. Off. . |
| 0 422 649 A1 | 4/1991 | European Pat. Off. . |
| 0 672 533 A2 | 9/1995 | European Pat. Off. . |
| 0 765 761 A1 | 4/1997 | European Pat. Off. . |
| 4-246572 | 9/1992 | Japan . |
| 7-256978 | 10/1995 | Japan . |
| 8-142444 | 6/1996 | Japan . |
| 2 234 713 | 2/1991 | United Kingdom . |

*Primary Examiner*—Huan Tran
*Attorney, Agent, or Firm*—Oliff & Berridge, PLC

[57] ABSTRACT

To increase the degree of radial and axial alignments between a thermal head bar and a platen roller without being affected by the precision of manufacture and assembling of a cover adapted to be opened or closed by carrying either the thermal head bar or the platen roller in a thermal recorder, the thermal head bar is mounted to the cover or a housing of with two linear small plays and two small rotational plays, while forks provided at opposite longitudinal ends of the thermal head bar and radial cams provided at opposite ends of the platen roller are engaged with one another to restrict a radical alignment of the thermal head bar and the platen roller, while the fork provided at least at one longitudinal end of the thermal head bar and an axial cam provided at a corresponding end of the platen roller are engaged with one another to restrict an axial alignment of the thermal head bar and the platen roller.

5 Claims, 5 Drawing Sheets

THERMAL RECORDER WITH MEANS FOR IMPROVED ALIGNMENT OF THERMAL HEAD BAR AND PLATEN ROLLER

BACKGROUND OF THE INVENTION

1. Field of the Invention

The present invention relates to a thermal recorder, and more particularly, to an improvement of a thermal head bar support construction of the thermal recorder in view of the positioning of a thermal head bar relative to a platen roller.

2. Description of the Prior Art

In a thermal recorder having a thermal head bar bearing a linear array of a number of heat generating elements and a platen roller between which a thermally recording sheet such as a thermally perforatable stencil or a thermally chromophoric sheet is clamped and transferred in a direction of traversing the array of heat generating elements according to a rotation of the platen roller such that an image is generated in the thermally recording sheet by a digital heat generating actuation of the respective heat generating elements according to an image signal, it is generally conventional that the platen roller is mounted to either of a housing of the recorder and a cover pivotably mounted to the housing to be pivotable between an open position and a closed position, and the thermal head bar is mounted to the other of the housing and the cover, wherein the platen roller and the thermal head bar are pressed to one another with the array of heat generating elements of the thermal head bar being aligned to a generatrix of a cylindrical surface of the platen roller when the cover is in the closed position, while the platen roller and the thermal head bar are detached from one another when the cover is in the open position.

In such a construction of the thermal recorder, the precision with regard to how the array of heat generating elements of the thermal head bar is correctly aligned with a generatrix of the cylindrical surface of the platen roller and the precision with regard to how the thermal head bar and the platen roller are longitudinally correctly positioned relative to one another are dependent upon the precision of the pivotal opening and closing movement of the cover relative to the housing. In such a thermal recorder, since the cover is opened for the purpose of charging a thermally recording sheet between the thermal head bar and the platen roller as well as cleaning and maintenance of the thermal head bar and the platen roller, in order to ensure the convenience of those operations, the radius of the pivotal movement of the thermal head bar or the platen roller in the opening and closing of the cover is generally designed to be at least 15 cm. In this case, if an allowance of errors in the manufacture of the covers and the assembling of the covers to the housings should be, for example, 0.2% of the radius of pivotal movement of the thermal head bar or the platen roller, when the pivotal radius is, for example, 15 cm, the absolute error in the radius of the pivotal movement would reach 0.3 mm. Such an error is very substantial, as it is approximately 10% for an image like characters of a height of a few mm.

For a high quality and uniform thermal image to be generated in a thermally recording sheet by clamping it between a thermal head bar and a platen roller and selectively activating each of the heat generating elements constructing the array thereof, it is very important that the array of heat generating elements is pressed against the cylindrical surface of the platen roller correctly along a generatrix thereof and there occurs no unstable shifting between the array of heat generating elements and the platen roller in the axial direction.

SUMMARY OF THE INVENTION

In view of the above requirements, it is an object of the present invention to provide an improved thermal recorder in which the alignment of the array of heat generating elements of the thermal head bar to the platen roller is constantly maintained at a high precision with a constant definite suppression of relative biasing between the thermal head bar and the platen roller in the longitudinal direction thereof, while allowing an unavoidable error in the manufacture of the cover for supporting the thermal head bar or the platen roller and in the pivotal mounting of the cover to the housing.

According to the present invention, the above-mentioned object is accomplished by a thermal recorder comprising a housing, a cover pivotably mounted to said housing to be movable between an open position and a closed position relative to said housing, a platen roller mounted to either one of said housing and said cover, and a thermal head bar mounted to other one of said housing and said cover, said thermal head bar and said platen roller being adapted to be pressed together when said cover is in said closed position with an array of heat generating elements of said thermal head bar being laid on a cylindrical surface of said platen roller along a generatrix thereof and to be detached from one another when said cover is in said open position, wherein said thermal head bar has a pair of forks at longitudinally opposite ends thereof, while said platen roller has a pair of circular radial cams arranged coaxially thereto at opposite ends thereof and adapted to be engaged in a corresponding groove of each of said forks so as to radially align said thermal head bar with said platen roller when said thermal head bar and said platen approach to one another, said platen roller further having an axial cam at least at one end thereof adapted to engage with one of said forks so as to restrict a relative longitudinal position between said thermal head bar and said platen roller, said thermal head bar being mounted to said other of said housing and said cover at a longitudinally central portion thereof with a small play for movement which includes a small shifting in a first direction of longitudinal extension of said thermal head bar, a small shifting in a second direction substantially perpendicular to both said first direction and a direction of extension of said grooves of said forks, and a small rotation around each of two axes which are perpendicular to said first direction as well as one another.

When the mounting of the thermal head bar to the cover or the housing is made with a small play for shifting in two directions and a small play for rotation about two axes, while the restriction of the radial alignment between the thermal head bar and the platen roller and the restriction of the relative longitudinal positioning between the thermal head bar and the platen roller are made by the engagement of the forks provided at the longitudinally opposite ends of the thermal head bar with the radial cams provided at the opposite ends of the platen roller and the engagement of the axial cam provided at least at one end of the platen roller with one of the forks, since the width of the grooves of the forks and the corresponding diameter of the radial cams may be of the order of 1 cm, while the axial length of the axial cam acting against the fork may be of the order of 1 cm, such as to be one fifteenth as compared with the radius of the pivotal movement of the thermal head bar or the platen roller of the order of 15 cm, even when the rate of allowance in the manufacture of the radial and axial cams relative to the overall dimensions thereof is of the same order, the errors in the radial and longitudinal alignments between the thermal head bar and the platen roller are decreased to a rate such as 1/15.

The mounting of said thermal head bar to the other of said housing and said cover may be made via a support bar laid over said thermal head bar therealong on one side thereof opposite to other side thereof where said array of heat generating elements is provided, said support bar having an opening at a longitudinally central portion thereof elongated in the direction of extension of said thermal head bar, said thermal head bar being connected with said support bar by a headed bolt passed through said elongated opening except a head portion thereof and planted into said thermal head bar such that said thermal head bar is restricted by said headed bolt against a movement thereof relative to said support bar in a direction of detaching therefrom but can rock around the head portion of said headed bolt within a small angle and also can shift in a longitudinal direction of said support bar relative thereto within a small distance.

Said support bar may have a bearing opening at a longitudinally central portion thereof, said bearing opening being directed perpendicular to both a direction of longitudinal extension of said support bar and a direction of extension of said grooves of said forks, and a support pin may be passed through said bearing opening and mounted to the other of said housing and said cover, so that said support bar is shiftable along said support pin within a small distance and also tiltable relative thereto within a small angle.

Said thermal head bar and said support bar may be mutually approachable under a restriction by a plurality of washers disposed linearly along a rear surface of said thermal hear bar exactly opposite to a linear portion thereof where said array of heat generating elements is provided.

Said washers may each be engaged with said support bar and are each slidable over the rear surface of said thermal head bar.

BRIEF DESCRIPTION OF THE DRAWINGS

In the accompanying drawings.

Description of the Preferred Embodiment

In the following, the present invention will be described in the form of an embodiment with reference to the accompanying drawings.

Referring to FIGS. 1–5 showing an embodiment of the thermal recorder according to the present invention, 10 is a platen roller, and 12 is a thermal head bar.

The platen roller 10 is supported by a shaft 14 extending along the central axis thereof, with opposite ends of the shaft 14 being rotatably mounted to a housing 16.

Figure 4:
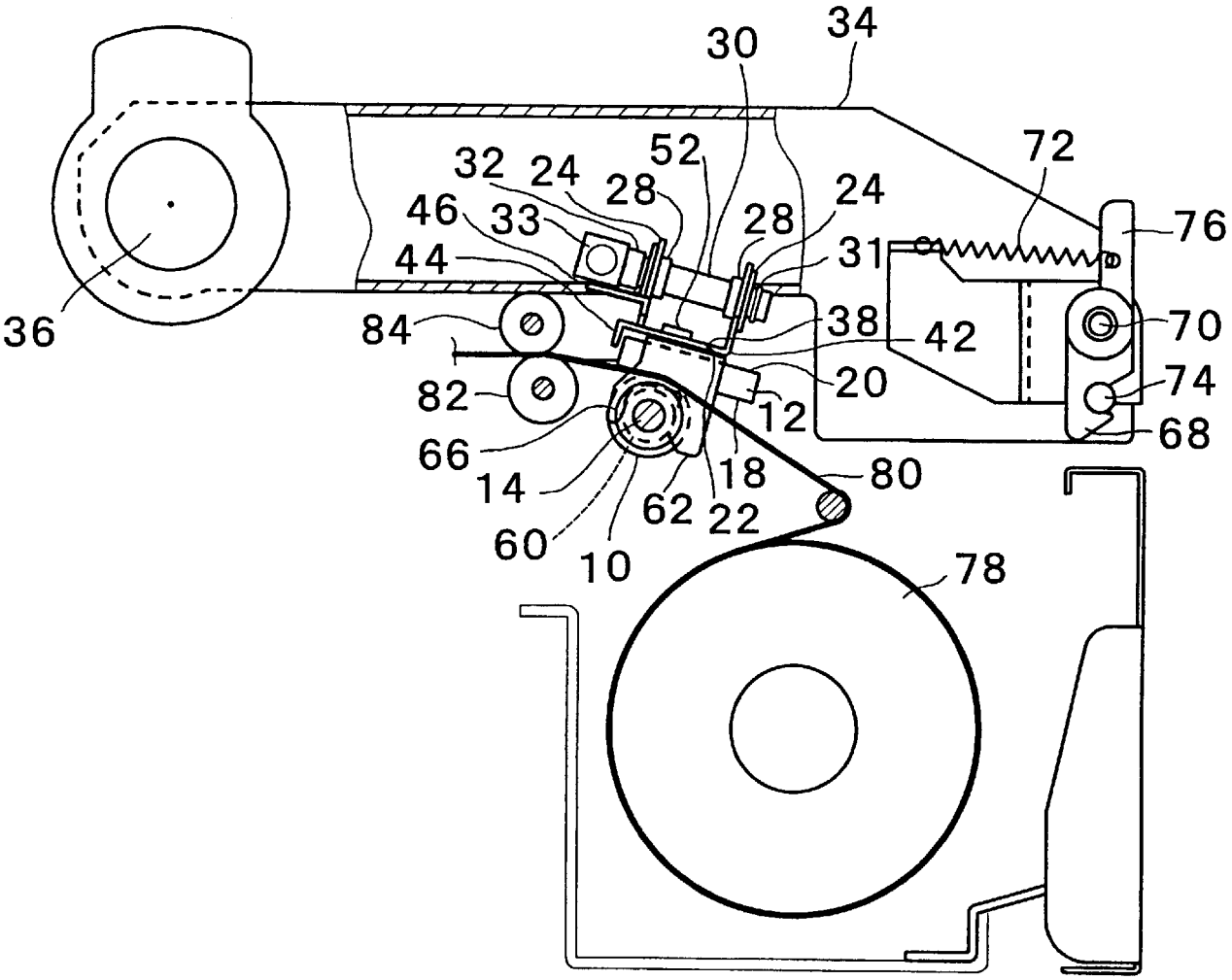
FIG. 4 is a side view showing the thermal recorder of FIG. 1, with the cover thereof at the closed position, while a part of the construction is shown in a section.
Figure 5:
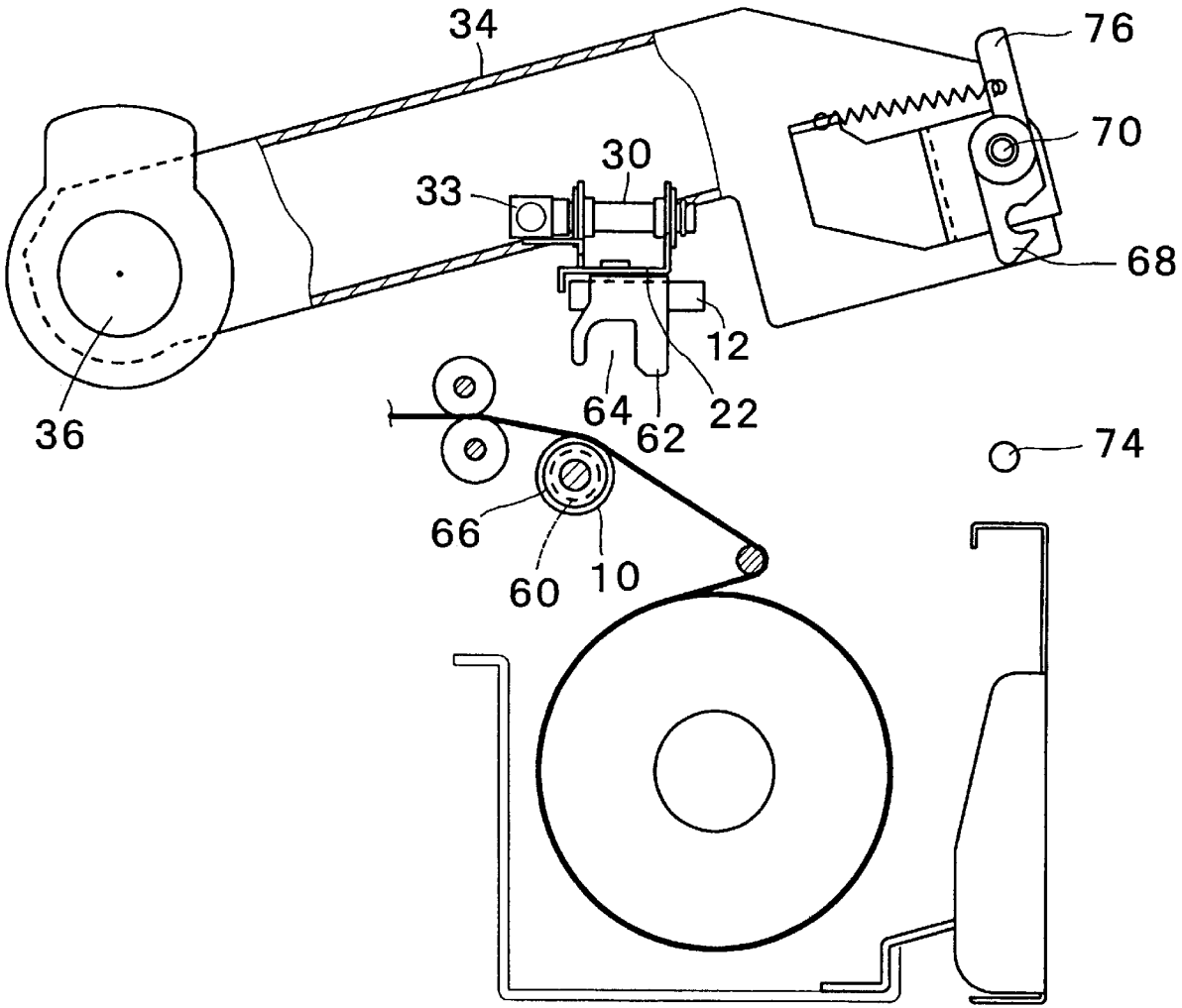
FIG. 5 is a side view of the thermal recorder of FIG. 1, with the cover thereof at a position slightly opened from the closed position, while a part of the construction is shown in a section.

The thermal head bar 12 is an elongated member having a substantially rectangular cross section, and carries a large number of heat generating elements disposed as an array thereof along a linear portion extending in the longitudinal direction of a front surface 18 facing the platen roller 10, though not shown in the figure. The thermal head bar 12 is engaged with a support bar 22 arranged to extend along a rear surface 20 thereof opposite to the front surface 18 in close proximity thereto in a manner described hereinbelow. In more detail, the support bar 22 has a pair of support lug portions 24 in which bearing openings 26 are formed to bear a pair of bearing pushes 28 through which a support pin 30 is inserted and mounted to a support rod 33 which in turn is supported by a cover 34 of the thermal recorder. The pair of support lug portions 24 of the support bar 22 are shiftable along the support pin 30 within a small distance between a stopper 31 mounted to the support pin 30 and an annular end face of a larger diameter portion 32 of the support pin 30. The cover 34 is pivotably mounted to the housing 16 by a pivot shaft 36, so that the cover 34 is pivotable between a closed position for pressing the thermal head bar 12 to the platen roller 10 as shown in FIG. 4 and an open position for detaching the thermal head bar 12 from the platen roller 10 as shown in FIG. 5.

Figure 1:
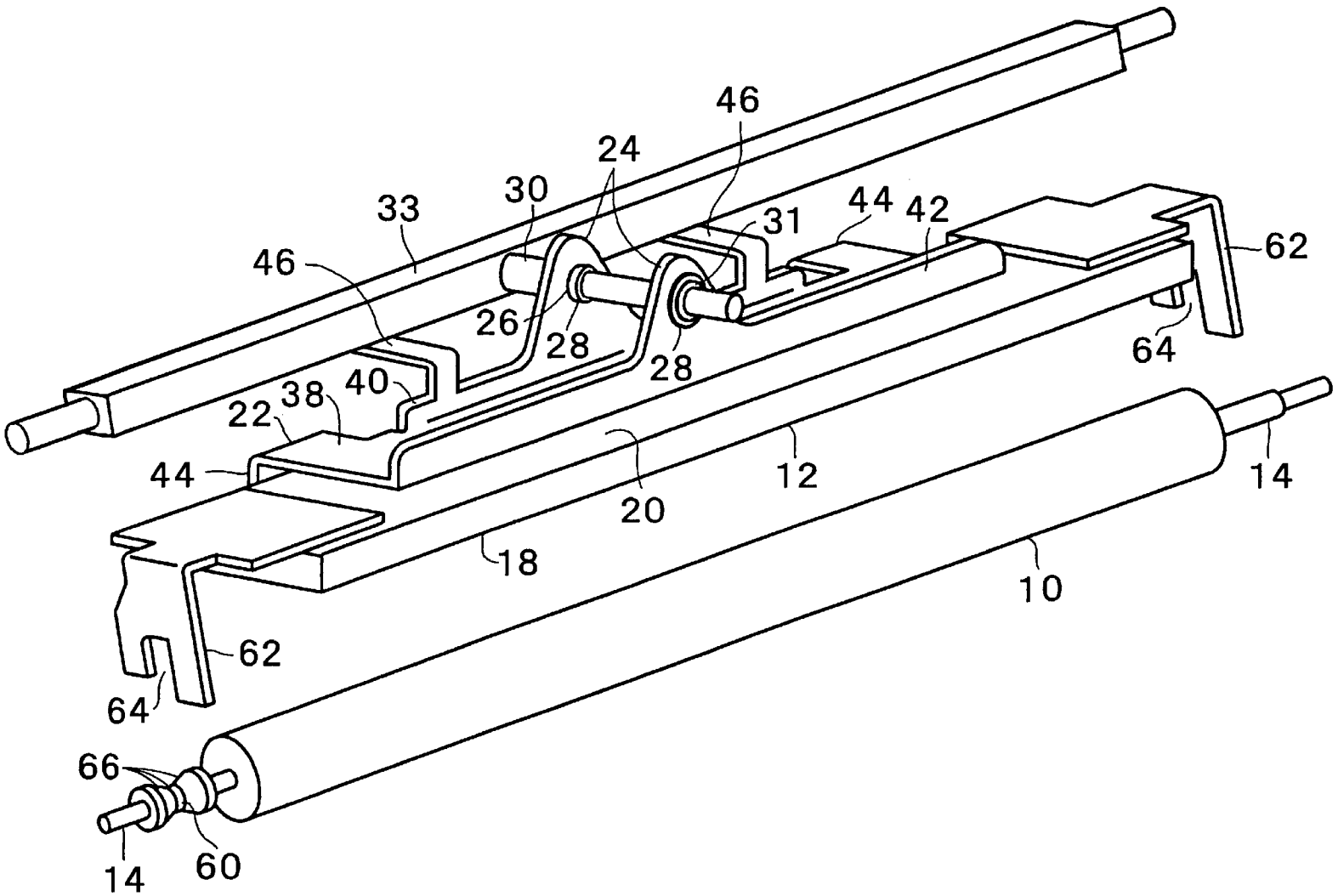
FIG. 1 is a perspective view showing an embodiment of the thermal recorder according to the present invention with a part of the construction thereof being removed for the convenience of illustration.

The support bar 22 is a member made of a relatively thin metal plate worked as shown in FIG. 1, so as to have a flat main portion 38 arranged to lay over the thermal head bar 12, rib portions 40 and 42 bent along opposite sides of the main portion, the above-mentioned pair of support lug portions 24 projecting from the rib portions, a pair of horizontal tilt restricting lug portions 44 bent downward from one side edge of the main portion 28, and a pair of vertical tilt restricting lug portions 46 extending upward from the rib portion 40 and then bent in a horizontal direction. The support bar 22 is formed with an elongated opening 48 at a longitudinally central portion thereof vertically aligned with the bearing openings 26, and four circular openings 50 longitudinally aligned with the elongated opening 48 on opposite sides thereof. A headed bolt 54 having a head portion 52 is passed through the elongated opening 48 with its shank portion by leaving the head portion 52 above the main portion 38, so that the shank portion is planted into the thermal head bar 12. A movement of the support bar 22 in the direction of detaching from the thermal head bar 12 is restricted by the head portion 52 of the headed bolt 54 engaging the upper surface of the main portion 38 along the periphery of the elongated opening 48. In each of the circular openings 50 there is mounted a washer 58 having a projection 56 extending upward through the circular opening. The base portions of the washers 58 work as a spacer for maintaining a constant clearance between the main portion 38 of the support bar 22 and the thermal head bar 12.

The lower end portions of the pair of horizontal tilt restricting lug portions 44 are each spaced slightly from a side edge of the thermal head bar 12, so that a horizontal relative tilt movement between the thermal head bar 12 and the support bar 22 around the headed bolt 54 is restricted within a small angle by either one of the lug portions 44 abutting the side edge of the thermal head bar 12. Similarly, the pair of vertical tilt restricting lug portions 46 are slightly spaced from a lower surface of the support rod 33, so that a vertical tilt movement of the support bar 22 relative to the support rod 33 around the support pin 30 is restricted within a small angle by either one of the lug portions 46 abutting the lower surface of the support rod 33. The support rod 33 is pivotably mounted to the cover 34 at opposite ends thereof, and is adapted to be selectively biased to rotate around a central axis thereof in the clockwise direction as viewed in FIGS. 4 and 5, by a solenoid means not shown in the figure, when the thermal head bar 12 is pressed against the platen roller 10 as shown in FIG. 4, thereby setting up a pressing force at a value proper for the execution of the thermal recording. The restriction of tilting of support bar 22 around the support pin 30 against the support rod 33 is the restriction of tilting of the support bar 22 around the support pin 30 against the cover 34.

Figure 2:
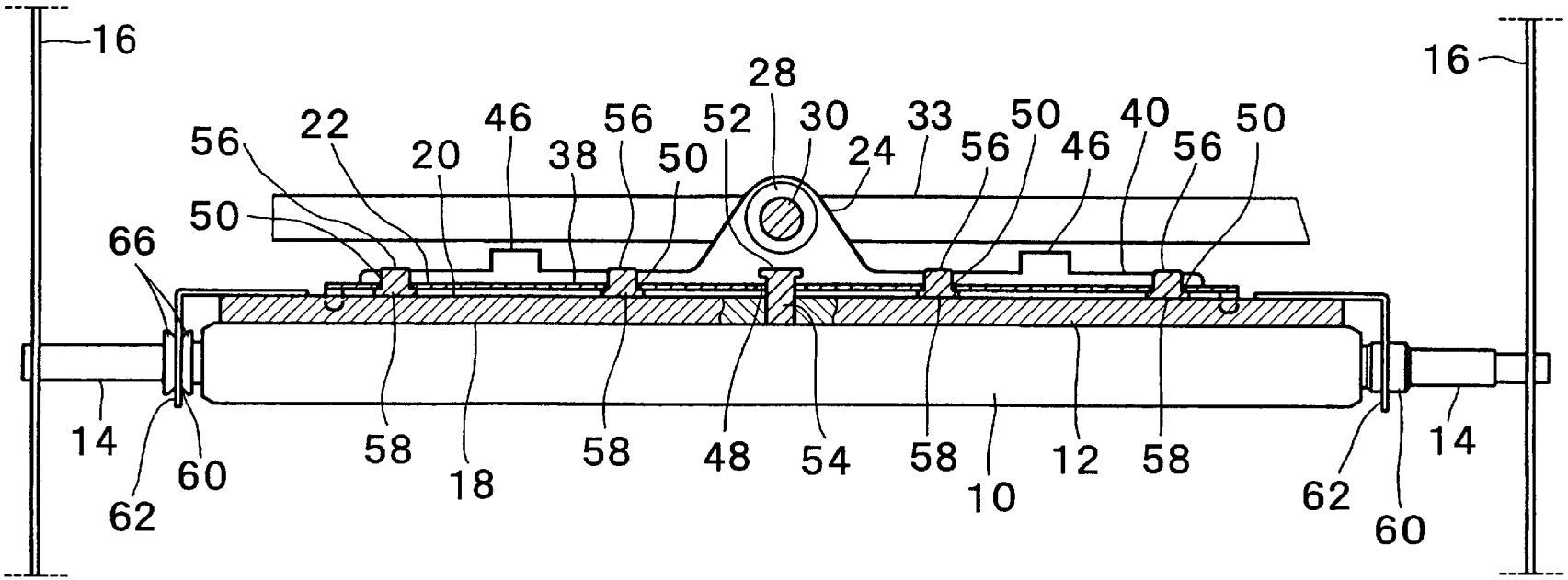
FIG. 2 is a side view showing the thermal recorder of FIG. 1, with a part thereof shown in a section.
Figure 3:
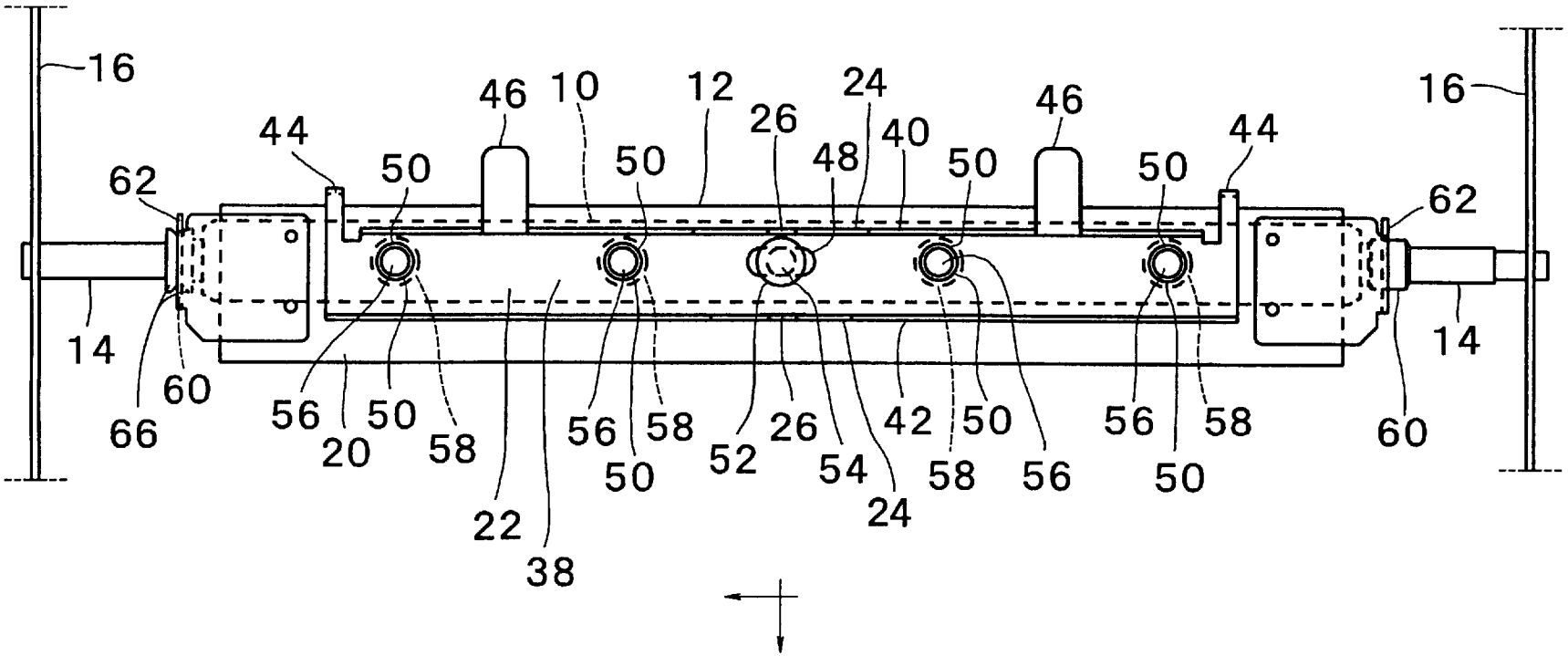
FIG. 3 is a plan view showing the thermal recorder of FIG. 1, with a part of the construction thereof being removed for the convenience of illustration.

The elongated opening 48 and the circular openings 50 of the support bar 22 are aligned along a straight line in the longitudinal direction of the support bar 22, while the center of the headed bolt 54 engaged in the elongated opening 48 is in alignment with the array of heat generating elements arranged along a straight line in the longitudinal direction of the front surface 18 of the thermal head bar 12. It is desirable that a small clearance is left between the head portion 52 of the headed bolt 54 and the upper surface of the main portion 38 of the support bar 22, so that the thermal head bar 12 can tilt within a small angle relative to the support bar 22 as viewed in the longitudinal direction thereof, i.e. in the direction following the axis of the platen roller, before the thermal head bar 12 is firmly pressed against the platen roller 10 by the support bar 22 as shown in FIGS. 2 and 4.

Thus, the thermal head bar 12 can move relative to the cover 34 within a small distance in the longitudinal direction thereof as much as the headed bolt 54 can shift in the elongated opening 48, can also move relative to the cover 34 within a small distance as much as the bearing openings 26 of the support lug portions of the support bar 22 can move along the support pin 30 between the stopper 31 and the annular end face of the larger diameter portion 32 of the support pin 30, can also tilt relative to the cover 34 within a small angle as much as the support bar 22 is allowed to rotate around the headed bolt 54 until the clearance between the horizontal tilt restricting lug portions 44 and the side edge of the thermal head bar 12 is canceled, and also can tilt relative to the cover 34 within a small angle as much as the support bar 22 is allowed to rotate around the support pin 30 until the clearance between the vertical tilt restricting lug portions 46 and the support rod 33 is canceled. Further, when a clearance is provided between the head portion 52 of the headed volt 54 and the upper surface of the main portion 38 of the support bar 22, the thermal head bar 12 is mounted to the cover 34 in a condition that it can tilt relative to the cover 34 within a small angle around an axis extending longitudinally along substantially the upper or lower surface of the main portion 38 of the support bar 22 through centers of the elongated opening 48 and the circular openings 50. In the shown embodiment, it is the thermal head bar 12 which is mounted to the cover 34. while it is the platen roller 10 which is mounted to the housing 16. However, conversely, the thermal head bar may be mounted to the housing in the same manner with a support bar so that a small play is allowed, while the platen roller may be mounted to the cover.

A radial cam 60 is provided at each of the opposite ends of the platen roller 10 along a portion of the shaft 14, and corresponding thereto a fork 62 is provided at each of the opposite ends of the thermal head bar 12. The forks 62 have each a groove 64 adapted to receive the radial cam 60 therein when the platen roller 10 and the thermal head bar 12 approach to one another. By the radial cams 60 being received in the grooves 64 of the forks 62, the platen roller 10 and the thermal head bar 12 are aligned with one another along a phantom plane extending to include the central axis of the platen roller and a center line of each of the grooves 64 of the forks 62. Further, when the platen roller 10 and the thermal head bar 12 are pressed to one another such that the platen roller 10 and the thermal head bar 12 contact directly with one another or sandwich a thermally recording sheet therebetween, the engagement of the forks and the radial cams restricts the relationship between the platen roller and the thermal head bar in the radially aligned state. When such a radial alignment has been accomplished, the array of heat generating elements provided in the front surface 18 of the thermal head bar 12 contact the cylindrical surface of the platen roller 10 along a generatrix thereof At least one of the opposite ends of the platen roller 10 there is provided an axial cam 66 adapted to engage with the groove 64 of a corresponding one of the forks 62, so as to restrict the axial relative position between the thermal head bar and the platen roller. The axial cam 66 has a pair of conically oblique surfaces positioned on axially opposite sides of a cylindrical portion serving as the radial cam 60, so that when the fork 62 approaches thereto, the groove 64 of the fork is engaged by the axial cam 66, thereby conducting the axial relationship therebetween to be as predetermined.

Thus, by the thermal head bar 12 being mounted to the cover 34 with a small play, while the radial alignment of the thermal head bar 12 relative to the platen roller 10 is restricted by the engagement of the radial cams 60 provided at the opposite ends of the platen roller with the forks 62 provided at the opposite ends of the thermal head bar 12, with a further restriction by the engagement between the axial cam 62 provided at least one of the opposite ends of the platen roller and the fork 62 provided at the corresponding end of the thermal head bar for restricting the axial relationship between the platen roller and the thermal head bar, even when the allowance of precision in the manufacture of the covers and that in the assembling of the covers to the housings by the pivot shafts 36 are relatively moderate, when the thermal head bar 12 and the platen roller 10 are finally pressed together, the radial alignment between the thermal head bar 12 and the platen roller 10, i.e. the alignment between the array of heat generating elements and the cylindrical surface of the platen roller is maintained to be an allowance of manufacture for a dimension of the order of 10 mm, so that if. for example, the allowance of manufacture is 0.2%, the absolute error in engagement is suppressed to the order of 0.02 mm. A similar precision is available with respect to the axial positioning between the platen roller and the thermal head bar.

When the cover 34 is approached from the open position to the close position, since there is the above-mentioned small play in the mounting of the thermal head bar 12 to the cover 34, the pair of radial cams 60 on the side of the platen roller and the pair of forks 62 on the side of the thermal head bar can smoothly and lightly enter into engagement with one another. In the engagement, the correct radial alignment is automatically accomplished by the support lug portions 24 of the support bar 22 slide appropriately along the support pin 30 at the bearing openings 26 thereof. In the meantime, when the thermal head bar 12 is tiltable around a straight line connecting the centers of the elongated opening 48 and the circular openings 50 within a small angle relative to the support bar 22 by a clearance provided between the head portion 52 of the headed bolt 54 and the upper surface of the main portion 38 of the support bar 22, the engagement between the radial cams 60 and the forks 62 is proceeded even more smoothly in the process of approaching the thermal head bar 12 and the platen roller 10 toward one another.

In FIGS. 4 and 5, 68 is a hook member pivotably mounted to the cover 34 by a pivot shaft 70. The hook member 68 is biased around the pivot shaft 70 in the anti-clockwise direction by a tension coil spring 72, so as to be kept in engagement with a stop pin 74 mounted to the housing 16, thereby maintaining the cover 34 in the closed position when it was once closed. When the cover 34 is to be opened, the hook member 68 is turned against the spring force of the tension coil spring 72 by a lever portion 76 thereof being pulled forward, so that it is released from the engagement with the stop pin 74.

A coil 78 of a thermally recording sheet such as a thermal stencil is charged in the housing, so that a thermally recording sheet 80 is pulled out therefrom to be transferred through between the thermal head bar 12 and the platen roller 10 as pressed therebetween according to the rotation of the platen roller 10 and forwarded through a pair of guide rollers 82 and 84 toward a processing unit such as a printing drum.

Although the present invention has been described in detail with respect to an embodiment thereof, it will be apparent for those skilled in the art that various modifications are possible with respect to the shown embodiment.

We claim:

1. A thermal recorder comprising:

a housing, a cover mounted to said housing to be pivotable between an open position and a closed position;

a platen roller mounted to one of said housing and said cover, and a thermal head bar having an array of heat generating elements and mounted to other of said housing and said cover, said thermal head bar adapted to be pressed together with said platen roller when said cover is in said closed position with said array of heat generating elements of said thermal head bar being laid on a cylindrical surface of said platen roller along a generatrix thereof and to be detached from said platen roller when said cover is in said open position, wherein said thermal head bar has a pair of forks at longitudinally opposite ends thereof, while said platen roller has a pair of circular radial cams arranged coaxially thereto at opposite ends thereof and adapted to be engaged in a corresponding groove of each of said forks so as to radially align said thermal head bar with said platen roller when said thermal head bar and said platen approach to one another, said platen roller further having an axial cam at lest at one end thereof adapted to engage with one of said forks so as to restrict a relative longitudinal position between said thermal head bar and said platen roller, said thermal head bar being mounted to said other of said housing and said cover at a substantially longitudinally central portion thereof with a small play for movement which includes a small shifting in a first direction of longitudinal extension of said thermal head bar;

a small shifting in a second direction substantially perpendicular to both said first direction and a direction of extension of said grooves of said forks, and a small rotation around each of first and second rotation axes, said first rotation axis extending substantially in said second direction, said second rotation axis extending substantially in the direction of extension of said grooves of said forks.

2. A thermal recorder according to claim 1, wherein the mounting of said thermal head bar to the other of said housing and said cover is made via a support bar laid over said thermal head bar therealong on one side thereof opposite to other side thereof where said array of heat generating elements is provided, said support bar having an opening at a substantially longitudinally central portion thereof elongated in the direction of extension of said thermal head bar, said thermal head bar being connected with said support bar by a headed bolt passed through said elongated opening except a head portion thereof and planted into said thermal head bar such that said thermal head bar is restricted by said headed bolt against a movement thereof relative to said support bar in a direction of detaching therefrom but can rock around the head portion of said headed bolt within a small angle and also can shift in a longitudinal direction of said support bar relative thereto within a small distance.

3. A thermal recorder according to claim 2, wherein said support bar has a bearing opening at a substantially longitudinally central portion thereof, said bearing opening being directed in said second direction, and a support pin is passed through said bearing opening and mounted to the other of said housing and said cover, so that said support bar is shiftable along said support pin within a small distance and also tiltable relative thereto about said support pin within a small angle.

4. A thermal recorder according to claim 2, wherein said thermal head bar and said support bar are mutually approachable under a restriction by a plurality of washers disposed linearly along a rear surface of said thermal head bar exactly opposite to a linear portion thereof where said array of heat generating elements is provided.

5. A thermal recorder according to claim 4, wherein said washers are each engaged with said support bar and are each slidable over the rear surface of said thermal head bar.

* * * * *